US012188239B2

(12) United States Patent
Nilsson et al.

(10) Patent No.: US 12,188,239 B2
(45) **Date of Patent: *Jan. 7, 2025**

(54) SET OF PANELS

(71) Applicant: Välinge Innovation AB, Viken (SE)

(72) Inventors: Anders Nilsson, Helsingborg (SE); Karl Quist, Höganäs (SE); Roger Ylikangas, Lerberget (SE); Fredrik Boo, Kågeröd (SE)

(73) Assignee: Välinge Innovation AB, Viken (SE)

( * ) Notice: Subject to any disclaimer, the term of this patent is extended or adjusted under 35 U.S.C. 154(b) by 275 days.

This patent is subject to a terminal disclaimer.

(21) Appl. No.: 17/716,622

(22) Filed: Apr. 8, 2022

(65) Prior Publication Data

US 2022/0228372 A1 Jul. 21, 2022

Related U.S. Application Data

(63) Continuation of application No. 17/029,658, filed on Sep. 23, 2020, now Pat. No. 11,326,353.

(30) Foreign Application Priority Data

Sep. 24, 2019 (EP) ..... 19199250

(51) Int. Cl.
*E04F 15/02* (2006.01)
*E04F 15/10* (2006.01)

(52) U.S. Cl.
CPC .. *E04F 15/02038* (2013.01); *E04F 15/02033* (2013.01); *E04F 15/105* (2013.01);
(Continued)

(58) Field of Classification Search
CPC ..... E04F 15/02038; E04F 15/02033; E04F 15/105; E04F 2201/0146;
(Continued)

(56) References Cited

U.S. PATENT DOCUMENTS 7,051,486 B2 5/2006 Pervan
7,454,875 B2 11/2008 Pervan et al.
(Continued)

FOREIGN PATENT DOCUMENTS

WO WO 2014/209213 A1 12/2014
WO WO 2018/063047 A1 4/2018
WO WO 2018/172955 A2 9/2018

OTHER PUBLICATIONS

U.S. Appl. No. 16/253,465, Darko Pervan and Marcus Nilsson StÅhl, filed Jan. 22, 2019, (Cited herein as US Patent Application Publication No. 2019/0394314 A1 of Dec. 26, 2019 and as Republication No. US 2020/0412852 A9 of Dec. 31, 2020.
(Continued)

*Primary Examiner* — Brent W Herring
(74) *Attorney, Agent, or Firm* — Boone IP Law

(57) ABSTRACT

A set of panels including first and second panels. The first and second panels respectively include first and second edges. The first edge includes a locking strip with a locking element configured to cooperate with a locking groove at the second edge for locking the first edge to the second edge. The locking element includes a first locking surface at a first angle from a plane parallel to the first panel surface and the locking groove includes a second locking surface at a second angle from a plane parallel to the third panel surface. The first angle is different from the second angle such that the first locking surface converges towards the second locking surface at a cooperation part in a locked position. The first locking surface cooperates with the second locking surface at the cooperation part.

20 Claims, 7 Drawing Sheets

(52) U.S. Cl.
CPC ..... *E04F 2201/0138* (2013.01); *E04F 2201/0146* (2013.01); *E04F 2201/0169* (2013.01); *E04F 2201/023* (2013.01); *E04F 2201/043* (2013.01); *E04F 2201/0535* (2013.01); *E04F 2201/0547* (2013.01)

(58) Field of Classification Search
CPC ..... E04F 2201/0535; E04F 2201/0547; E04F 2201/043; E04F 2201/023; E04F 2201/0138; E04F 2201/0169
See application file for complete search history.

(56) References Cited

U.S. PATENT DOCUMENTS 7,584,583 B2 9/2009 Bergelin et al.
7,634,884 B2 12/2009 Pervan
7,637,068 B2 12/2009 Pervan
7,677,005 B2 3/2010 Pervan
7,721,503 B2 5/2010 Pervan et al.
7,757,452 B2 7/2010 Pervan
7,802,411 B2 9/2010 Pervan
7,841,144 B2 11/2010 Pervan et al.
7,841,145 B2 11/2010 Pervan et al.
7,841,150 B2 11/2010 Pervan
7,861,482 B2 1/2011 Pervan et al.
7,866,110 B2 1/2011 Pervan
7,908,815 B2 3/2011 Pervan et al.
7,930,862 B2 4/2011 Bergelin et al.
7,980,041 B2 7/2011 Pervan
7,980,043 B2 * 7/2011 Moebus ..... E04F 15/04 52/592.1
8,033,074 B2 10/2011 Pervan
8,042,311 B2 10/2011 Pervan
8,061,104 B2 11/2011 Pervan
8,079,196 B2 12/2011 Pervan
8,112,967 B2 2/2012 Pervan et al.
8,171,692 B2 5/2012 Pervan
8,181,416 B2 5/2012 Pervan et al.
8,234,830 B2 8/2012 Pervan et al.
8,281,549 B2 10/2012 Du
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,365,499 B2 2/2013 Nilsson et al.
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,528,289 B2 9/2013 Pervan et al.
8,544,230 B2 10/2013 Pervan
8,544,234 B2 10/2013 Pervan et al.
8,572,922 B2 11/2013 Pervan
8,596,013 B2 12/2013 Boo
8,627,862 B2 1/2014 Pervan et al.
8,640,424 B2 2/2014 Pervan et al.
8,650,826 B2 2/2014 Pervan et al.
8,677,714 B2 3/2014 Pervan
8,689,512 B2 4/2014 Pervan
8,707,650 B2 4/2014 Pervan
8,713,886 B2 5/2014 Boo et al.
8,733,065 B2 5/2014 Pervan
8,733,410 B2 5/2014 Pervan
8,745,952 B2 6/2014 Perra et al.
8,756,899 B2 6/2014 Nilsson et al.
8,763,341 B2 7/2014 Pervan
8,769,905 B2 7/2014 Pervan
8,776,473 B2 7/2014 Pervan et al.
8,806,832 B2 8/2014 Kell
8,844,236 B2 9/2014 Pervan et al.
8,857,126 B2 10/2014 Pervan et al.
8,869,485 B2 10/2014 Pervan
8,898,988 B2 12/2014 Pervan
8,925,274 B2 1/2015 Pervan et al.
8,959,866 B2 2/2015 Pervan
8,973,331 B2 3/2015 Boo
8,978,336 B2 3/2015 Perra et al.
9,027,306 B2 5/2015 Pervan
9,051,738 B2 6/2015 Pervan et al.
9,068,360 B2 6/2015 Pervan
9,091,077 B2 7/2015 Boo
9,103,126 B2 8/2015 Kell
9,109,366 B2 8/2015 Schulte
9,194,134 B2 11/2015 Nygren et al.
9,212,492 B2 12/2015 Pervan et al.
9,216,541 B2 12/2015 Boo et al.
9,238,917 B2 1/2016 Pervan et al.
9,249,581 B2 2/2016 Nilsson et al.
9,284,737 B2 3/2016 Pervan et al.
9,309,679 B2 4/2016 Pervan et al.
9,316,002 B2 4/2016 Boo
9,340,974 B2 5/2016 Pervan et al.
9,347,469 B2 5/2016 Pervan
9,359,774 B2 6/2016 Pervan
9,366,036 B2 6/2016 Pervan
9,376,821 B2 6/2016 Pervan
9,382,716 B2 7/2016 Pervan et al.
9,388,584 B2 7/2016 Pervan et al.
9,428,919 B2 8/2016 Pervan et al.
9,453,347 B2 9/2016 Pervan
9,458,634 B2 10/2016 Derelov
9,482,012 B2 11/2016 Nygren et al.
9,540,826 B2 1/2017 Pervan et al.
9,663,940 B2 5/2017 Boo
9,725,912 B2 8/2017 Pervan
9,771,723 B2 9/2017 Pervan
9,777,487 B2 10/2017 Pervan et al.
9,803,374 B2 10/2017 Pervan
9,803,375 B2 10/2017 Pervan
9,856,656 B2 1/2018 Pervan
9,874,027 B2 1/2018 Pervan
9,885,187 B2 * 2/2018 Kell ..... E04F 15/02033
9,945,130 B2 4/2018 Nygren et al.
9,951,526 B2 4/2018 Boo et al.
10,000,935 B2 6/2018 Kell
10,006,210 B2 6/2018 Pervan et al.
10,017,948 B2 7/2018 Boo
10,047,527 B2 8/2018 Nilsson et al.
10,113,319 B2 10/2018 Pervan
10,125,488 B2 11/2018 Boo
10,138,636 B2 11/2018 Pervan
10,161,139 B2 12/2018 Pervan
10,180,005 B2 1/2019 Pervan et al.
10,214,915 B2 2/2019 Pervan et al.
10,214,917 B2 2/2019 Pervan et al.
10,240,348 B2 3/2019 Pervan et al.
10,240,349 B2 3/2019 Pervan et al.
10,246,883 B2 4/2019 Derelöv
10,280,627 B2 * 5/2019 De Rick ..... E04F 13/0889
10,352,049 B2 7/2019 Boo
10,358,830 B2 7/2019 Pervan
10,378,217 B2 8/2019 Pervan
10,458,125 B2 10/2019 Pervan
10,480,196 B2 11/2019 Boo
10,519,676 B2 12/2019 Pervan
10,526,792 B2 1/2020 Pervan et al.
10,526,793 B2 1/2020 Nilsson et al.
10,538,922 B2 1/2020 Pervan
10,570,625 B2 2/2020 Pervan
10,640,989 B2 5/2020 Pervan
10,655,339 B2 5/2020 Pervan
10,669,723 B2 6/2020 Pervan et al.
10,683,668 B2 * 6/2020 De Rick ..... E04F 15/02038
10,724,251 B2 7/2020 Kell
10,731,358 B2 8/2020 Pervan
10,738,477 B2 * 8/2020 Hannig ..... E04F 15/105
10,794,065 B2 10/2020 Boo
10,828,798 B2 11/2020 Fransson
10,933,592 B2 3/2021 Blomgren et al.
10,934,721 B2 3/2021 Pervan et al.
10,947,741 B2 3/2021 Bouckéet al.
10,953,566 B2 3/2021 Fransson et al.

(56) References Cited

U.S. PATENT DOCUMENTS 10,968,639 B2 4/2021 Pervan et al.
10,975,577 B2 4/2021 Pervan et al.
10,995,501 B2 5/2021 Pervan
11,015,351 B2 5/2021 De Rick
11,045,933 B2 6/2021 Fransson et al.
11,053,691 B2 7/2021 Pervan
11,053,692 B2 7/2021 Pervan
11,060,302 B2 7/2021 Ylikangas et al.
11,066,835 B2 7/2021 Boo
11,078,673 B2 8/2021 Pervan et al.
11,091,920 B2 8/2021 Kell
11,131,099 B2 9/2021 Pervan
11,174,646 B2 11/2021 Pervan
11,193,283 B2 12/2021 Pervan et al.
11,261,608 B2 3/2022 Pervan
11,274,453 B2 3/2022 Pervan
11,326,353 B2 5/2022 Nilsson et al.
11,331,824 B2 5/2022 Myllykangas et al.
2002/0007609 A1* 1/2002 Pervan ..... E04F 15/04 52/592.2
2004/0016196 A1 1/2004 Pervan
2005/0021081 A1 1/2005 Lebner
2005/0160694 A1 7/2005 Pervan
2005/0210810 A1 9/2005 Pervan
2006/0070333 A1 4/2006 Pervan
2006/0101769 A1 5/2006 Pervan
2006/0236642 A1 10/2006 Pervan
2006/0260254 A1* 11/2006 Pervan ..... E04F 15/04 52/592.1
2008/0000186 A1 1/2008 Pervan et al.
2008/0000187 A1 1/2008 Pervan et al.
2008/0010931 A1 1/2008 Pervan et al.
2008/0010937 A1 1/2008 Pervan et al.
2008/0028707 A1 2/2008 Pervan
2008/0034708 A1 2/2008 Pervan
2008/0041008 A1 2/2008 Pervan
2008/0066415 A1 3/2008 Pervan
2008/0104921 A1 5/2008 Pervan et al.
2008/0110125 A1 5/2008 Pervan
2008/0134607 A1 6/2008 Pervan
2008/0134613 A1 6/2008 Pervan
2008/0134614 A1 6/2008 Pervan
2008/0155930 A1 7/2008 Pervan et al.
2008/0216434 A1 9/2008 Pervan
2008/0216920 A1 9/2008 Pervan
2008/0295432 A1 12/2008 Pervan et al.
2009/0133353 A1* 5/2009 Pervan ..... H01F 7/122 52/747.1
2009/0193748 A1 8/2009 Boo et al.
2010/0018147 A1* 1/2010 Du ..... E04F 15/02038 52/506.05
2010/0293879 A1* 11/2010 Pervan ..... H01F 7/0252 52/588.1
2010/0300031 A1 12/2010 Pervan et al.
2010/0319290 A1 12/2010 Pervan
2010/0319291 A1 12/2010 Pervan et al.
2011/0030303 A1 2/2011 Pervan et al.
2011/0041996 A1 2/2011 Pervan
2011/0056167 A1 3/2011 Nilsson et al.
2011/0088344 A1 4/2011 Pervan et al.
2011/0088345 A1 4/2011 Pervan
2011/0154763 A1 6/2011 Bergelin et al.
2011/0167750 A1 7/2011 Pervan
2011/0225922 A1 9/2011 Pervan et al.
2011/0252733 A1 10/2011 Pervan
2011/0283650 A1 11/2011 Pervan et al.
2012/0017533 A1 1/2012 Pervan et al.
2012/0031029 A1 2/2012 Pervan et al.
2012/0036804 A1 2/2012 Pervan
2012/0151865 A1 6/2012 Pervan et al.
2012/0174515 A1 7/2012 Pervan
2012/0174519 A1* 7/2012 Schulte ..... E04F 13/08 29/428
2012/0174520 A1 7/2012 Pervan
2012/0180416 A1* 7/2012 Perra ..... E04F 15/02038 52/309.1
2012/0279161 A1 11/2012 Håkansson et al.
2013/0008117 A1 1/2013 Pervan
2013/0014463 A1 1/2013 Pervan
2013/0019555 A1 1/2013 Pervan
2013/0042562 A1 2/2013 Pervan
2013/0042563 A1 2/2013 Pervan
2013/0042564 A1 2/2013 Pervan et al.
2013/0042565 A1 2/2013 Pervan
2013/0047536 A1 2/2013 Pervan
2013/0081349 A1 4/2013 Pervan et al.
2013/0111758 A1 5/2013 Nilsson et al.
2013/0111845 A1 5/2013 Pervan
2013/0145708 A1 6/2013 Pervan
2013/0160391 A1 6/2013 Pervan et al.
2013/0232905 A2 9/2013 Pervan
2013/0239508 A1 9/2013 Pervan et al.
2013/0263454 A1 10/2013 Boo et al.
2013/0263547 A1 10/2013 Boo
2013/0318906 A1 12/2013 Pervan et al.
2014/0007539 A1 1/2014 Pervan et al.
2014/0020324 A1 1/2014 Pervan
2014/0033633 A1 2/2014 Kell
2014/0033634 A1 2/2014 Pervan
2014/0053497 A1 2/2014 Pervan et al.
2014/0059966 A1 3/2014 Boo
2014/0069043 A1 3/2014 Pervan
2014/0069044 A1* 3/2014 Wallin ..... E04F 15/041 52/588.1
2014/0090335 A1 4/2014 Pervan et al.
2014/0109501 A1 4/2014 Pervan
2014/0109506 A1 4/2014 Pervan et al.
2014/0123586 A1 5/2014 Pervan et al.
2014/0186104 A1* 7/2014 Hamberger ..... F16B 5/0016 403/292
2014/0190112 A1 7/2014 Pervan
2014/0208677 A1 7/2014 Pervan et al.
2014/0223852 A1 8/2014 Pervan
2014/0237924 A1 8/2014 Nilsson et al.
2014/0237931 A1 8/2014 Pervan
2014/0250813 A1 9/2014 Nygren et al.
2014/0260060 A1 9/2014 Pervan et al.
2014/0305065 A1 10/2014 Pervan
2014/0366476 A1 12/2014 Pervan
2014/0366477 A1 12/2014 Kell
2014/0373478 A2 12/2014 Pervan et al.
2014/0373480 A1 12/2014 Pervan et al.
2015/0000221 A1 1/2015 Boo
2015/0013260 A1 1/2015 Pervan
2015/0059281 A1 3/2015 Pervan
2015/0089896 A2 4/2015 Pervan et al.
2015/0121796 A1 5/2015 Pervan
2015/0152644 A1 6/2015 Boo
2015/0167318 A1 6/2015 Pervan
2015/0211239 A1 7/2015 Pervan
2015/0233125 A1 8/2015 Pervan et al.
2015/0267419 A1 9/2015 Pervan
2015/0300029 A1 10/2015 Pervan
2015/0330088 A1 11/2015 Derelov
2015/0337537 A1 11/2015 Boo
2015/0368910 A1 12/2015 Kell
2016/0032596 A1 2/2016 Nygren et al.
2016/0060879 A1 3/2016 Pervan
2016/0069088 A1 3/2016 Boo et al.
2016/0076260 A1 3/2016 Pervan et al.
2016/0090744 A1 3/2016 Pervan et al.
2016/0108624 A1 4/2016 Nilsson et al.
2016/0153200 A1 6/2016 Pervan
2016/0168866 A1 6/2016 Pervan et al.
2016/0186426 A1 6/2016 Boo
2016/0194884 A1 7/2016 Pervan et al.
2016/0201336 A1 7/2016 Pervan
2016/0251859 A1 9/2016 Pervan et al.
2016/0251860 A1 9/2016 Pervan
2016/0281368 A1 9/2016 Pervan et al.
2016/0281370 A1 9/2016 Pervan et al.
2016/0326751 A1 11/2016 Pervan
2016/0340913 A1 11/2016 Derelöv

(56) References Cited

U.S. PATENT DOCUMENTS

| | | | | |
|---|---|---|---|---|
| 2017/0037641 | A1 | 2/2017 | Nygren et al. | |
| 2017/0081860 | A1 | 3/2017 | Boo | |
| 2017/0254096 | A1 | 9/2017 | Pervan | |
| 2017/0321433 | A1 | 11/2017 | Pervan et al. | |
| 2017/0362834 | A1 | 12/2017 | Pervan et al. | |
| 2018/0000151 | A1 | 1/2018 | Yang et al. | |
| 2018/0001509 | A1 | 1/2018 | Myllykangas et al. | |
| 2018/0001510 | A1 | 1/2018 | Fransson | |
| 2018/0001573 | A1 | 1/2018 | Blomgren et al. | |
| 2018/0002933 | A1 | 1/2018 | Pervan | |
| 2018/0016783 | A1 | 1/2018 | Boo | |
| 2018/0030737 | A1 | 2/2018 | Pervan | |
| 2018/0030738 | A1 | 2/2018 | Pervan | |
| 2018/0094441 | A1 | 4/2018 | Boo | |
| 2018/0119431 | A1 | 5/2018 | Pervan et al. | |
| 2018/0178406 | A1 | 6/2018 | Fransson et al. | |
| 2018/0313093 | A1 | 11/2018 | Nilsson et al. | |
| 2019/0024387 | A1 | 1/2019 | Pervan | |
| 2019/0048592 | A1 | 2/2019 | Boo | |
| 2019/0048596 | A1 | 2/2019 | Pervan | |
| 2019/0063076 | A1 | 2/2019 | Boo et al. | |
| 2019/0093370 | A1 | 3/2019 | Pervan et al. | |
| 2019/0093371 | A1 | 3/2019 | Pervan | |
| 2019/0119928 | A1 | 4/2019 | Pervan et al. | |
| 2019/0127989 | A1 | 5/2019 | Kell | |
| 2019/0127990 | A1 | 5/2019 | Pervan et al. | |
| 2019/0169859 | A1 | 6/2019 | Pervan et al. | |
| 2019/0232473 | A1 | 8/2019 | Fransson et al. | |
| 2019/0271165 | A1 | 9/2019 | Boo | |
| 2019/0376298 | A1 | 12/2019 | Pervan et al. | |
| 2019/0394314 | A1 | 12/2019 | Pervan et al. | |
| 2020/0087927 | A1 | 3/2020 | Pervan | |
| 2020/0102756 | A1 | 4/2020 | Pervan | |
| 2020/0109569 | A1 | 4/2020 | Pervan | |
| 2020/0131785 | A1* | 4/2020 | Boucké | E04F 15/10 |
| 2020/0149289 | A1 | 5/2020 | Pervan | |
| 2020/0173175 | A1 | 6/2020 | Pervan | |
| 2020/0224430 | A1 | 7/2020 | Ylikangas et al. | |
| 2020/0232226 | A1 | 7/2020 | De Rick | |
| 2020/0263437 | A1 | 8/2020 | Pervan | |
| 2020/0277796 | A1 | 9/2020 | Wo | |
| 2020/0284045 | A1 | 9/2020 | Kell | |
| 2020/0299973 | A1* | 9/2020 | Boucké | E04F 15/02038 |
| 2020/0318667 | A1 | 10/2020 | Derelöv | |
| 2020/0354969 | A1 | 11/2020 | Pervan et al. | |
| 2020/0362567 | A1 | 11/2020 | Nilsson et al. | |
| 2020/0412852 | A9 | 12/2020 | Pervan et al. | |
| 2021/0002907 | A1* | 1/2021 | Boucké | E04F 15/02038 |
| 2021/0016465 | A1 | 1/2021 | Fransson | |
| 2021/0047840 | A1 | 2/2021 | Pervan | |
| 2021/0047841 | A1 | 2/2021 | Pervan et al. | |
| 2021/0071428 | A1 | 3/2021 | Pervan | |
| 2021/0087831 | A1 | 3/2021 | Nilsson et al. | |
| 2021/0087832 | A1 | 3/2021 | Boo | |
| 2021/0087833 | A1 | 3/2021 | Ylikangas et al. | |
| 2021/0087834 | A1 | 3/2021 | Ylikangas et al. | |
| 2021/0310256 | A1* | 10/2021 | Boo | E04F 15/04 |
| 2021/0310257 | A1 | 10/2021 | Boo | |
| 2021/0348396 | A1 | 11/2021 | Pervan et al. | |
| 2021/0381252 | A1 | 12/2021 | Fahle | |
| 2021/0381255 | A1 | 12/2021 | Ylikangas et al. | |
| 2022/0025657 | A1 | 1/2022 | Pervan | |
| 2022/0025658 | A1 | 1/2022 | Kell | |
| 2022/0143718 | A1 | 5/2022 | Pervan et al. | |

OTHER PUBLICATIONS

U.S. Appl. No. 17/030,923, Christian Boo, filed Sep. 24, 2020, (Cited herein as US Patent Application Publication No. 2021/0087832 A1 of Mar. 25, 2021).

U.S. Appl. No. 17/030,966, Roger Ylikangas and Thomas Meijer, filed Sep. 24, 2020, (Cited herein as US Patent Application Publication No. 2021/0087833 A1 of Mar. 25, 2021).

U.S. Appl. No. 17/031,166, Roger Ylikangas, Thomas Meijer and Anders Nilsson, filed Sep. 24, 2020, (Cited herein as US Patent Application Publication No. 2021/0087834 A1 of Mar. 25, 2021).

U.S. Appl. No. 17/368,075, Richard William Kell, filed Jul. 6, 2021, (Cited herein as US Patent Application Publication No. 2022/0025658 A1 of Jan. 27, 2022).

U.S. Appl. No. 17/825,654, Roger Ylikangas and Thomas Meijer, filed May 26, 2022.

International Search Report and Written Opinion mailed Dec. 3, 2020 in PCT/EP2020/076547, European Patent Office, Rijswijk, NL, 9 pages.

Extended European Search Report mailed Apr. 6, 2020 in EP 19199250.2, European Patent Office, Munich, DE, 7 pages.

Ylikangas, Roger, et al., U.S. Appl. No. 17/825,654 entitled "Panel with Locking Device," filed in the U.S. Patent and Trademark Office on May 26, 2022.

U.S. Appl. No. 18/407,549, Karl Quist, filed Jan. 9, 2024.

International Preliminary Report on Patentability received for PCT Patent Application No. PCT/EP2020/076547, mailed on Apr. 7, 2022, 8 pages.

U.S. Appl. No. 17/825,654, Roger Ylikangas, filed May 26, 2022.

U.S. Appl. No. 17/842,122, Christian Boo, filed Jun. 16, 2022.

U.S. Appl. No. 18/057,811, Darko Pervan, filed Nov. 22, 2022.

U.S. Appl. No. 18/176,003, Richard William Kell, filed Feb. 28, 2023.

U.S. Appl. No. 18/309,118, Christian Boo, filed Apr. 28, 2023.

U.S. Appl. No. 18/223,091, Roger Ylikangas, filed Jul. 18, 2023.

* cited by examiner

SET OF PANELS

CROSS REFERENCE TO RELATED APPLICATIONS

The present application is a continuation of U.S. patent application Ser. No. 17/029,658, filed on Sep. 23, 2020, which claims the benefit of European Application No. 19199250.2, filed on Sep. 24, 2019. The entire contents of U.S. patent application Ser. No. 17/029,658 and European Application No. 19199250.2 are hereby incorporated herein by reference in their entirety.

TECHNICAL FIELD

Embodiments of the present disclosure relates to panels, such as floorboards, which are configured to be locked together by a vertical displacement.

BACKGROUND

Panels are known that are configured to be assembled by a vertical displacement and to be locked together in a vertical direction and in a horizontal direction. Such panels are disclosed in, e.g., WO2018/063047 and WO2014/209213. A tongue and groove connection locks a first edge of a first panel to a second edge of the second panel in a second direction.

The first edge and the second edge furthermore comprise a locking element configured to cooperate with a locking groove for locking in a first direction, which is perpendicular to the second direction.

Embodiments of the present disclosure address a need to provide an easier assembling and/or an increased locking strength of the panels.

SUMMARY

It is an object of at least certain embodiments of the present disclosure to provide an improvement over the above described techniques and known art.

A further object of at least certain embodiments of the present disclosure is to facilitate assembling of panels configured to be assembled by a vertical displacement and locked together in the vertical direction and the horizontal direction.

Another object of at least certain embodiment of the present disclosure is to increase the locking strength by preventing or at least decreasing damage of edges of the panels, particularly parts of the edges that have a locking function. The locking strength may also be increased by an improved configuration of locking surfaces at the edges of the panels.

At least some of these and other objects and advantages that may be apparent from the description have been achieved by a first aspect of the disclosure including a set of panels comprising a first panel and a second panel, wherein the first panel comprising a first edge, a first panel surface and a second opposite panel surface and the second panel comprises a second edge, a third panel surface and an opposite fourth panel surface. The first edge comprises a locking strip with a locking element configured to cooperate with a locking groove at the second edge of the second panel for locking the first edge to the second edge in a first direction which is parallel to the first panel surface. The first edge is configured to be assembled to the second edge by a displacement of the second edge relative the first edge in an assembly direction, which is perpendicular to the first panel surface, to obtain a locked position of the first edge and the second edge. The locking element comprises a first locking surface at a first angle from a plane parallel to the first panel surface and the locking groove comprises a second locking surface at a second angle from a plane parallel to the third panel surface. The first angle is different from the second angle such that the first locking surface converges towards the second locking surface at a cooperation part in the locked position. The first locking surface cooperates with the second locking surface at the cooperation part for the locking in the first direction.

The converging locking surfaces may have the effect that a load in the first direction, e.g. from a force pulling apart the panels, is absorbed at a part with a shorter moment arm. A shorter moment arm may have the advantage that the locking strength is increased.

The converging locking surfaces may have the effect that the area of contact between the first and the second locking surface is decreased during assembling. The decreased area of contact during assembling may have the advantage that the friction during assembling is decreased and the assembling is facilitated.

The locking element may comprise a first guiding surface at an outer surface and the locking groove may comprise a second guiding surface at an opening of the locking groove. The first guiding surface is configured to cooperate with the second guiding surface during assembling to guide the locking element into the locking groove.

The size of the first guiding surface may be greater than the size of the second guiding surface which may have the effect that the guiding is improved.

The first guiding surface may comprise an essentially planar surface.

The second guiding surface may have a rounded shape.

A ratio between a length of the planar surface and a radius of the rounded shape may be in the range of about 1 to about 5, or about 2 to about 4, or about 3.

The cooperation part may be closer to a strip surface of the locking strip than to an outer surface of the locking element.

There may be a space between the first locking surface and the second locking surface in the locked position, wherein the space is located between the cooperation part and an outer surface of the locking element.

An outer part of the locking element may be damaged during the assembling if the panel material is brittle or comprises imperfections. The space may have the advantage that it allows a desired locked position to be reached even in an event that an outer part of the locking element is damaged.

The difference between the first angle and the second angle may be in the range of about 5° to about 15°, or in the range of about 5° to about 10°, or about 7°.

The cooperation part may be positioned at a first distance from a strip surface of the locking strip, wherein an outer surface of the locking element is positioned at a second distance from a strip surface of the locking strip, and wherein a ratio between the first distance and the second distance is in the range of about 0.03 to about 0.3, or in the range of about 0.1 to about 0.2, 03, or about 0.15.

The first edge or the second edge may comprise a tongue which is configured to cooperate with a tongue groove at the other of the first edge or the second edge for a locking in a second direction which is perpendicular to the first direction.

The tongue may be a flexible tongue which is located in an insertion groove at the first edge or the second edge.

The first angle may be in the range of about 90° to about ° 145, or in the range of about 100° to about 135°, or in the range of about 110° to about 125°, or about 120° and wherein the second angle may be in the range of about 80° to about 135°, or in the range of about 100° to about 115°, or about 110°.

The locking surface and second locking surface may be configured for a locking in a second direction which is perpendicular to the first direction.

The first angle may be in the range of about 70° to about 90°, or in the range of about 80° to about 89°, or in the range of about 85° to about 89°, and the second angle may be in the range of about 75° to about 85°, or in the range of about 80° to about 85°.

The panels may comprise a polymer material or a wood based material.

The distance between the first panel surface and the second panel surface may be in the range of about 3 mm to about 15 mm, or in the range of about 5 mm to about 8 mm.

A distance between the third panel surface and the fourth panel surface may be in the range of about 3 mm to about 15 mm, or in the range of about 5 mm to about 8 mm.

The first panel surface and the third panel surface may comprise a decorative surface.

The assembling may comprise a displacement in the horizontal direction.

The first and the second panel may be of a rectangular shape.

The first and the second panel may be building panels, such as floor panels, wall panels or ceiling panels.

The first edge and the second edge may be short edges of the first and the second panel.

The assembling may also comprise an angling motion along a long side of the first and/or the second panel. The angling motion may at the same time connect the long side of the first and/or the second panel to a side of a third panel by a mechanical locking device.

The first panel and the second panel may be resilient panels. The resilient panels may comprise a core comprising thermoplastic material. The thermoplastic material may be foamed.

The thermoplastic material may comprise polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof. The core may be formed of several layers.

The first panel and the second panel may comprise a decorative layer, such as a decorative foil comprising a thermoplastic material. The thermoplastic material of the decorative layer may be or comprise polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof. The decorative foil is preferably printed, for example by direct printing, rotogravure, or digital printing.

The first panel and the second panel may comprise a wear layer such as a film or foil. The wear layer may comprise thermoplastic material. The thermoplastic material may be polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof.

Embodiments of the disclosure may be particularly advantageous for panels comprising locking surfaces with higher friction.

The first and the second panel may comprise a wood-based core, such as HDF, MDF or plywood.

BRIEF DESCRIPTION OF THE DRAWINGS

These and other aspects, features and advantages of which embodiments of the disclosure are capable of, will be apparent and elucidated from the following description of embodiments of the present disclosure, reference being made to the accompanying drawings, in which.

DESCRIPTION OF EMBODIMENTS

Figure 1A:
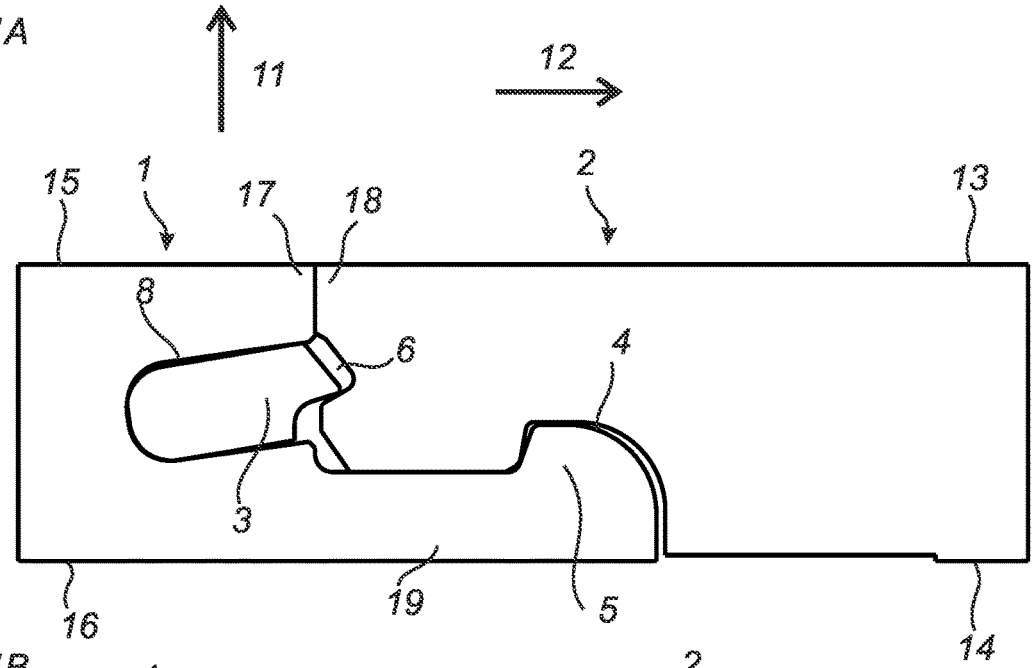
FIGS. 1A-1C show illustrative embodiments of the set of panels in a locked position.

Specific embodiments of the disclosure will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the disclosure to those skilled in the art. The terminology used in the detailed description of the embodiments illustrated in the accompanying drawings is not intended to be limiting of the invention. In the drawings, like numbers refer to like elements.

Embodiments of the set of panels are according to the disclosure are shown in a locked position in FIGS. 1A-1C and 7. The set of panels comprises a first panel 1 and a second panel 2, wherein the first panel 1 comprises a first edge 17, a first panel surface 15 and a second opposite panel surface 16, and wherein the second panel 2 comprises a second edge 18, a third panel surface 13 and an opposite fourth panel surface 14. The first edge 17 comprises a locking strip 19 with a locking element 5 configured to cooperate with a locking groove 4 at the second edge 18 of the second panel 2 for locking the first edge 17 to the second edge 18 in a first direction 12 which is parallel to the first panel surface 15. The first edge 17 is configured to be assembled to the second edge 18 by a displacement of the second edge 18 relative the first edge 17 in an assembly direction 10, which is perpendicular to the first panel surface 15, to obtain a locked position of the first edge 17 and the second edge 18

Figure 3A:
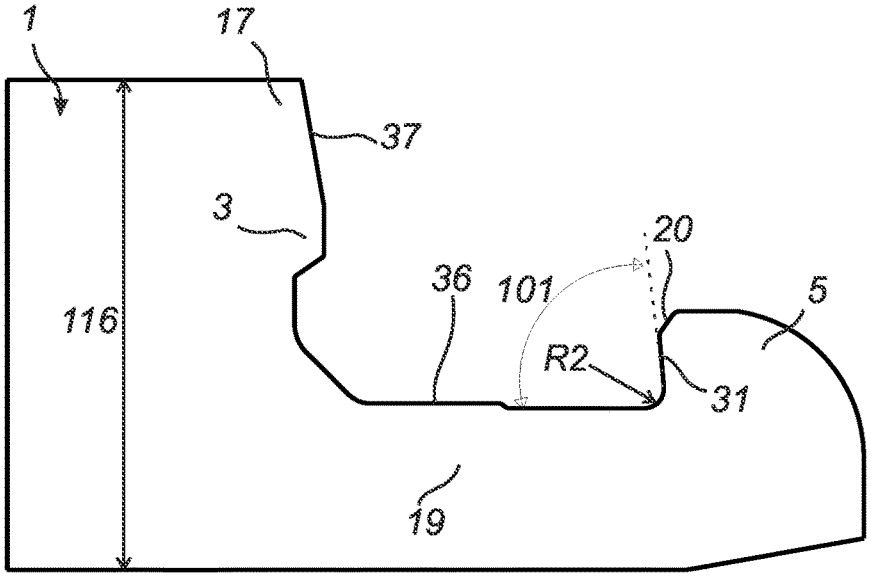
FIGS. 3A-3B show the illustrative embodiment of FIG. 1B before assembling.
Figure 3B:
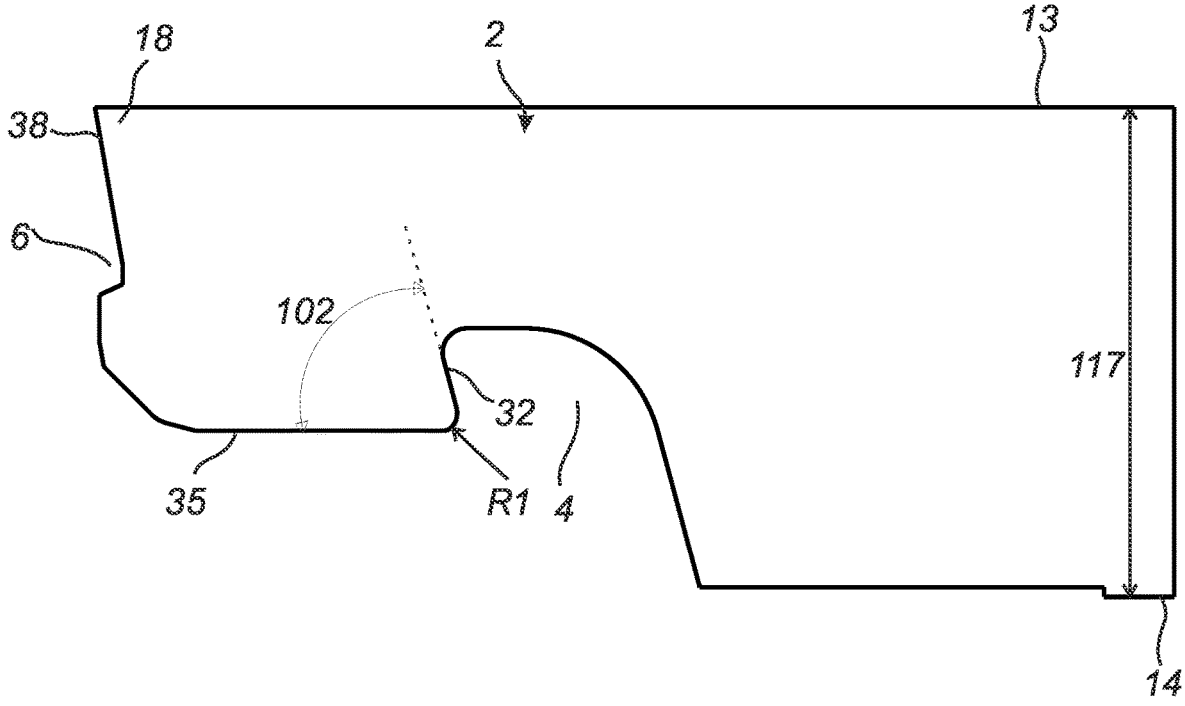

As shown for example in FIGS. 3A and 3B, the locking element 5 comprises a first locking surface 31 at a first angle 101 from a plane parallel to the first panel surface 15 and the locking groove 4 comprises a second locking surface 32 at a second angle 102 from a plane parallel to the third panel surface 13. The first angle 101 is different from the second angle 102 such that the first locking surface 31 converges towards the second locking surface 32 at a cooperation part 104 (see, e.g., FIGS. 5 and 6) in the locked position, and that the first locking surface 31 cooperates with the second locking surface 32 at the cooperation part 104 for the locking in the first direction 12. In illustrative embodiments, the cooperation part 104 is a point of intersection of the first locking surface 31 and the second locking surface 32. The converging locking surfaces may have the effect that a load in the first direction 12, e.g. from a force pulling apart the panels, is absorbed at a part with a shorter moment arm. A shorter moment arm may have the advantage that the locking strength is increased.

The converging locking surfaces may have the effect that the area of contact between the first and the second locking surface is decreased during assembling. The decreased area of contact during assembling may have the advantage that the friction during assembling is decreased and the assembling is facilitated.

Figure 1B:
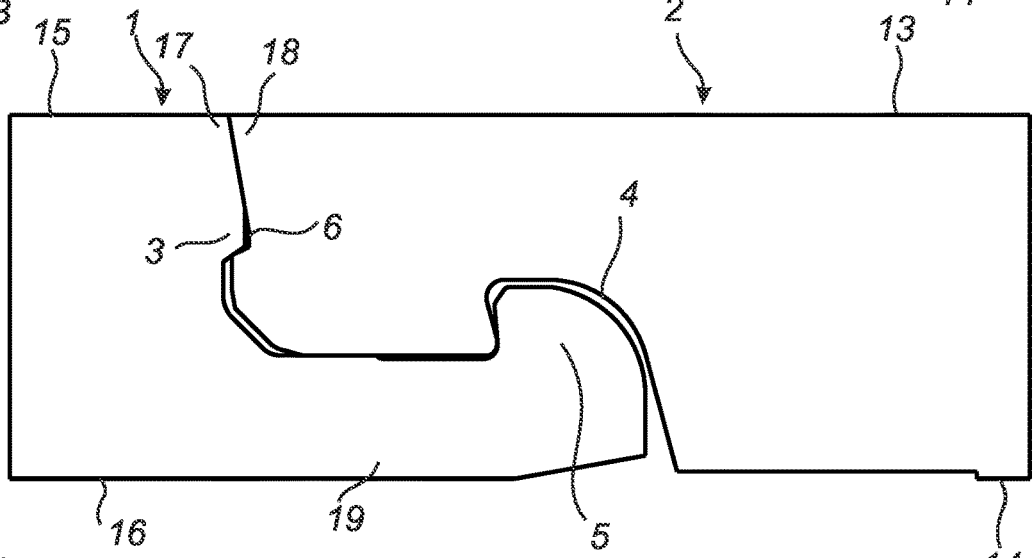
Figure 1C:
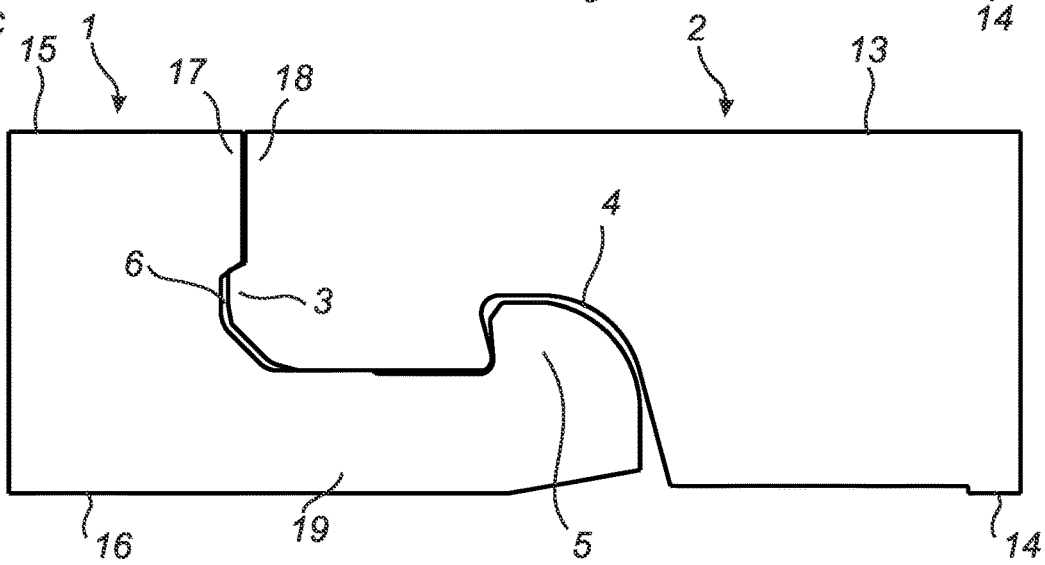
Figure 5:
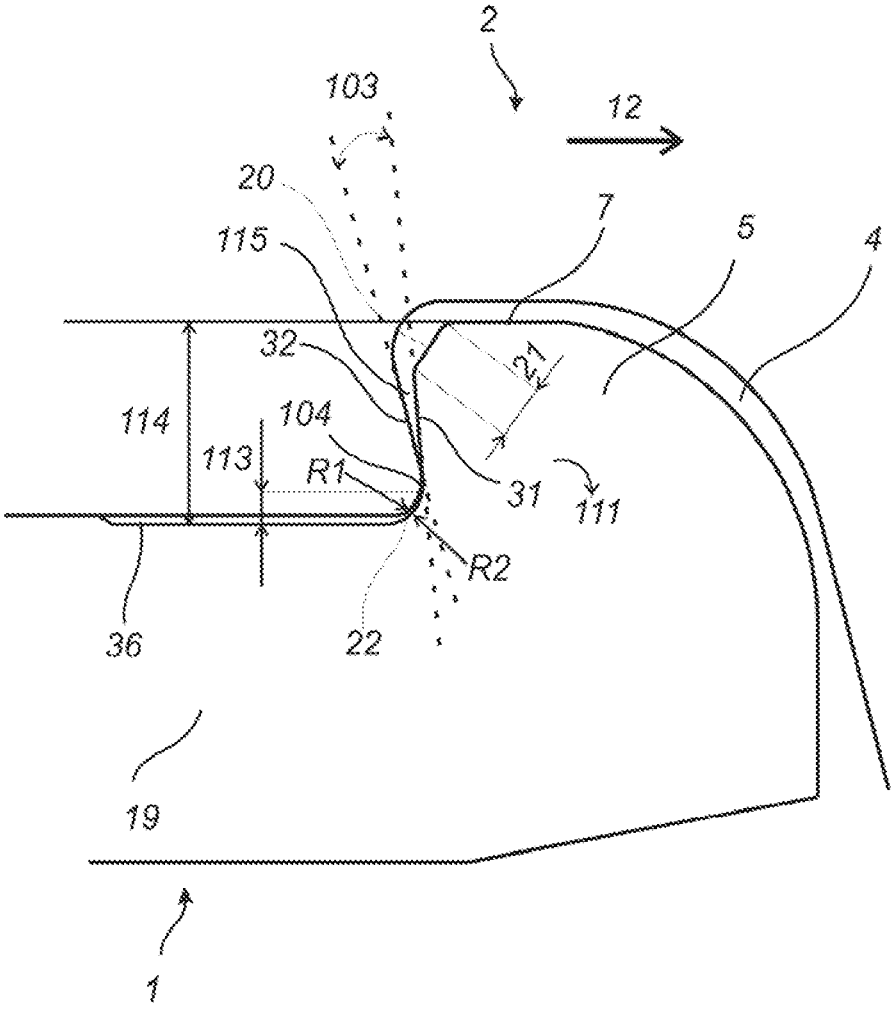
FIG. 5 shows an enlargement of the locking element, the locking strip and the locking groove of the illustrative embodiments of FIGS. 1B, 1C and 7.
Figure 7:
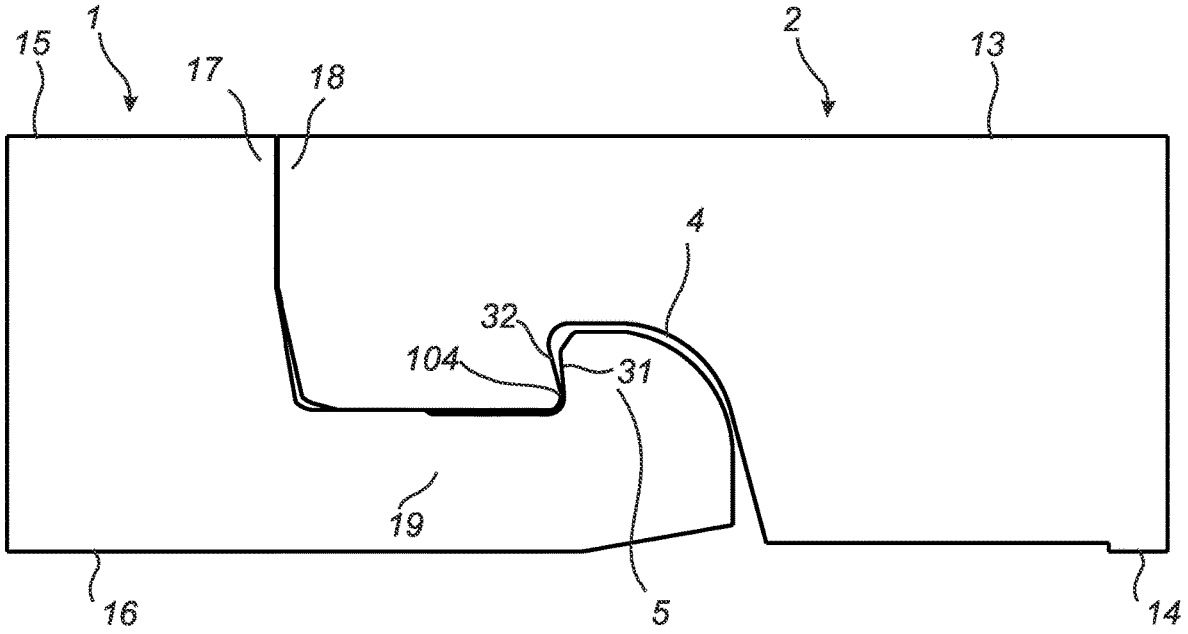
FIG. 7 shows an illustrative embodiment of the set of panels in a locked position.

FIG. 5 shows an enlargement of the locking element 5, the locking strip 19 and the locking groove 4 of the embodiments of FIGS. 1B, 1C and 7.

Figure 6:
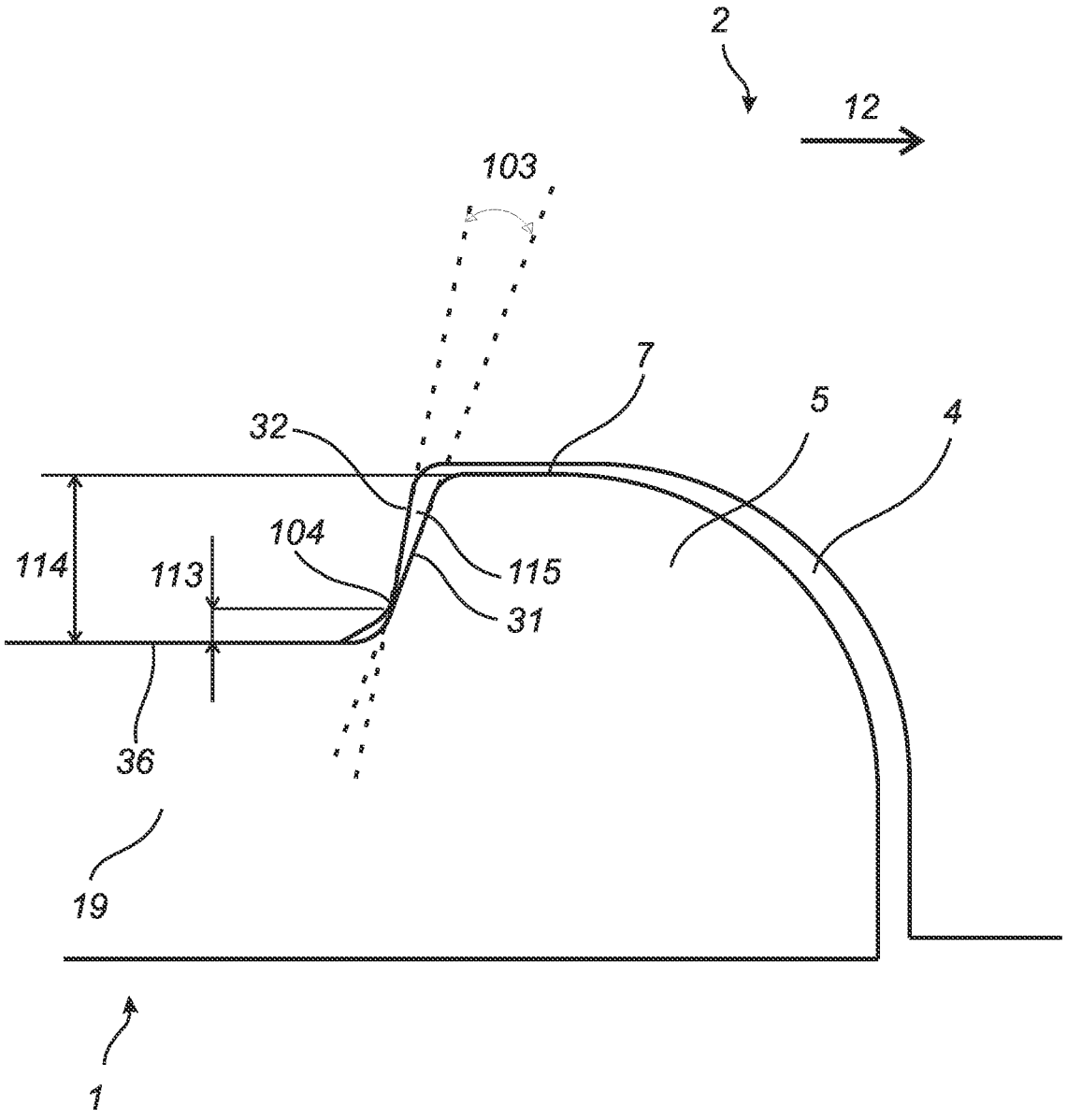
FIG. 6 shows an enlargement of the locking element, the locking strip and the locking groove of the illustrative embodiment of FIG. 1A.

FIG. 6 shows an enlargement of the locking element 5, the locking strip 19 and the locking groove 4 of the embodiment of FIG. 1A.

FIGS. 5 and 6 show embodiments comprising a cooperation part 104 which is closer to a strip surface 36 of the locking strip 19 than to an outer surface 7 of the locking element 5.

The outer surface 7 may be an outermost surface of the locking element 5. For example, in FIG. 5, the outer surface 7 may be an uppermost surface of the locking element 5.

The illustrative embodiments of FIGS. 5 and 6 comprise a space 115 between the first locking surface 31 and the second locking surface 32. The space is located between the cooperation part 104 and an outer surface 7 of the locking element 5.

The difference 103 between the first angle 101 and the second angle 102 may be in the range of about 2° to about 15°, or in the range of about 5° to about 10°, or in the range of about 5° to about 7°, or about 7. If the difference is smaller than 2° the space 115 may be too small to accommodate dust or particles from parts of the panels that are damaged during assembling or transportation. A greater difference, e.g. greater than 5°, may be an advantage since it allows lower production tolerances. A difference greater than 15° may be a disadvantage since it may result in a weak edge at the opening of the locking groove 4 at the second guiding surface 22.

It shall be understood that the term "about" includes a margin for a measurement error of 1°.

The cooperation part 104 is positioned at a first distance 113 from a strip surface 36 of the locking strip 19, wherein an outer surface 7 of the locking element 5 is positioned at a second distance 114 from a strip surface 36 of the locking strip 19, and wherein a ratio between the first distance 113 and the second distance 114 may be in the range of about 0.03 to about 0.3, or in the range of about 0.1 to about 0.2, about 0.3, or about 0.15. A short first distance has the advantage of a shorter moment arm. The second distance may be long enough to allow for the first guiding 20 surface and to reduce the risk that the locking element slides out from the locking groove when a high load is applied to the panels which may cause the locking strip to bend away from the locking groove.

FIGS. 1A-1C show that the first edge 17 or the second edge 18 may comprise a tongue 3 which is configured to cooperate with a tongue groove 6 at the other of the first edge 17 or the second edge 18 for a locking in a second direction 11 which is perpendicular to the first direction 12. FIG. 1A shows an embodiment comprising an embodiment of the tongue 3, which is a flexible tongue located in an insertion groove. The insertion groove may be located at the first edge 17 or at the second edge 18. FIGS. 1B-1C shows an embodiment comprising an embodiment of the tongue 3 which may be formed, e.g. by mechanically cutting, of a material of the panels.

Embodiments which comprise a tongue 3 at the first or the second edge and tongue groove 6 at the other of the first edge 17 or the second edge 18 for a locking in a second direction 11 may comprise an embodiment of the first angle 101 which may be in the range of about 90° to about ° 145, or in the range of about 100° to about 135°, or in the range of about 110° to about 125°, or about 120° and an embodiment of the second angle 102 which may in the range of about 80° to about 135°, or in the range of about 100° to about 115°, or about 110°.

As shown for example in FIG. 5, the embodiments shown in FIGS. 1B-1C and FIG. 7 comprise a first locking surface 31 and a second locking surface 32 which are configured for a locking in a second direction 11 perpendicular to the first direction 12. Embodiments of the first angle 101 may be in the range of about 70° to about 90°, or in the range of about 80° to about 89°, or in the range of about 85° to about 89°, and embodiments of the second angle 102 may be in the range of about 75° to about 85°, or in the range of about 80° to about 85°.

Figure 2A:
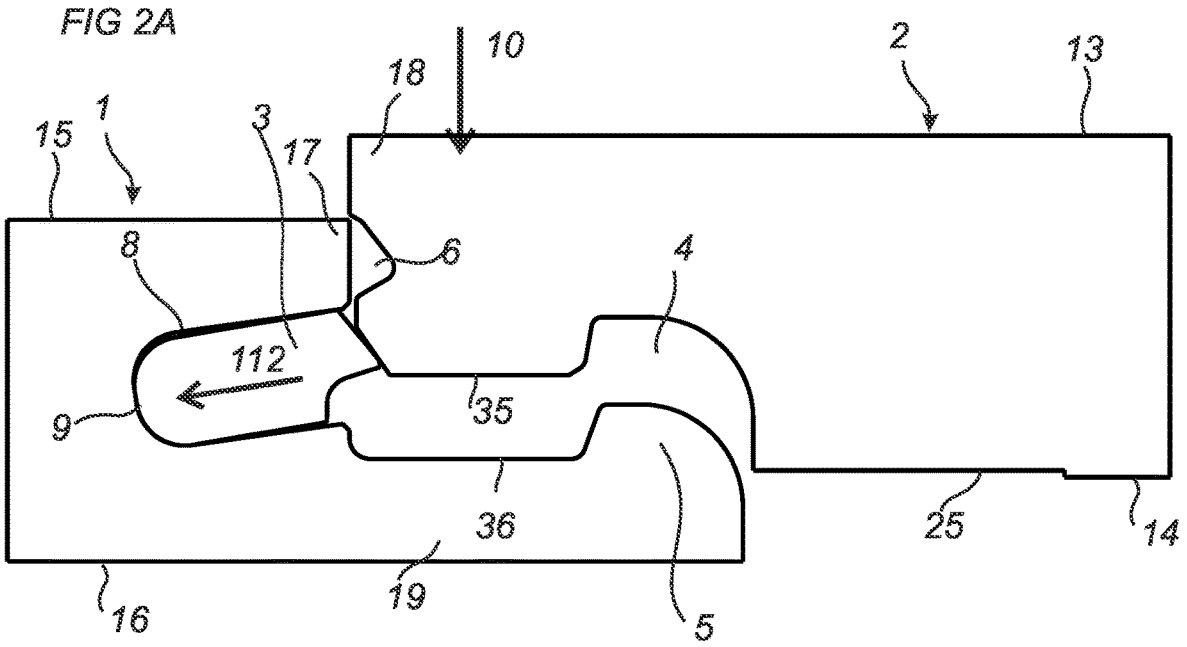
FIG. 2A shows the illustrative embodiment in FIG. 1A during assembling.
Figure 4A:
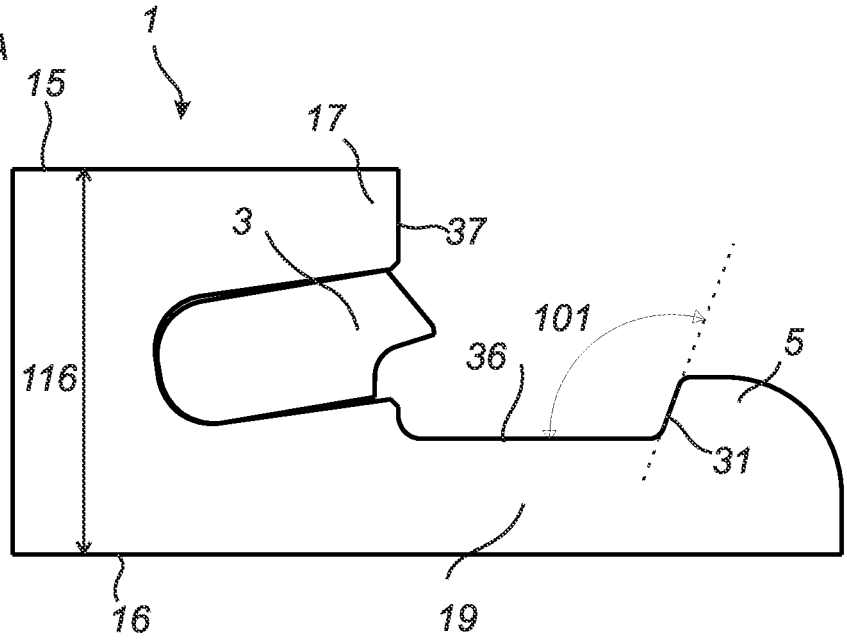
FIGS. 4A-4B show the illustrative embodiment of FIG. 1A before assembling
Figure 4B:
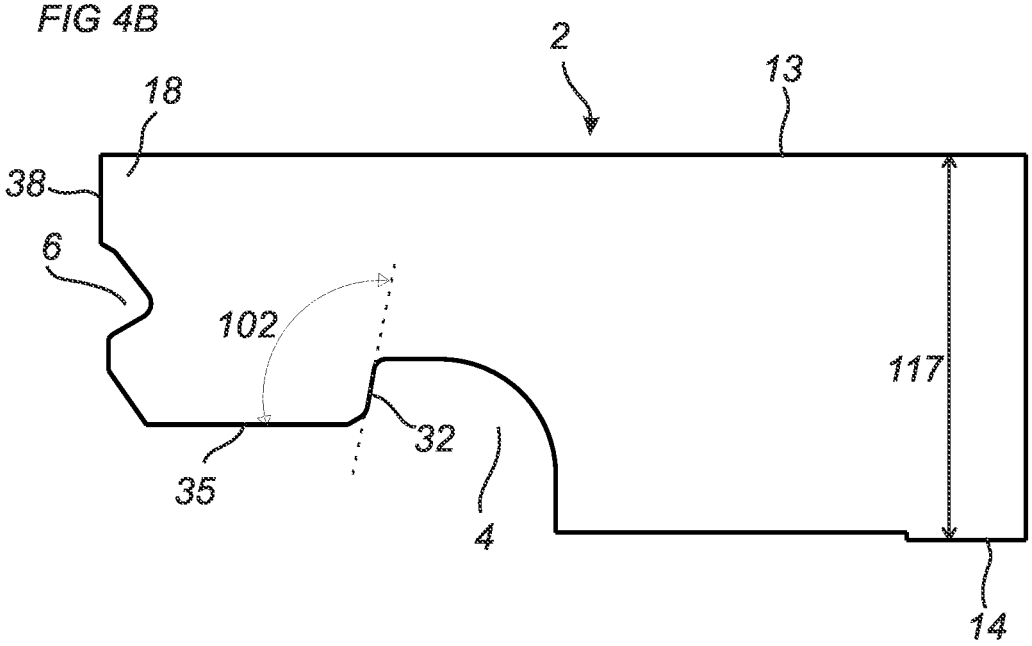

FIG. 2A shows the embodiment shown in FIG. 1A during an illustrative assembling. The second edge 18 of the second panel 2 is being displaced in an assembly direction 10 relative of the first edge 17 of the first panel 1 to obtain a locked position of the first edge and the second edge. The assembly direction 10 may be perpendicular to the first panel surface 15. FIGS. 4A-4B show the embodiment before assembling.

The flexible tongue may be compressed and/or displaced, during the assembling, in a direction 112 toward a bottom 9 of the insertion groove 8. The flexible tongue is configured to spring back when the first edge 17 and the second edge 18 have reached the locked position.

Figure 2B:
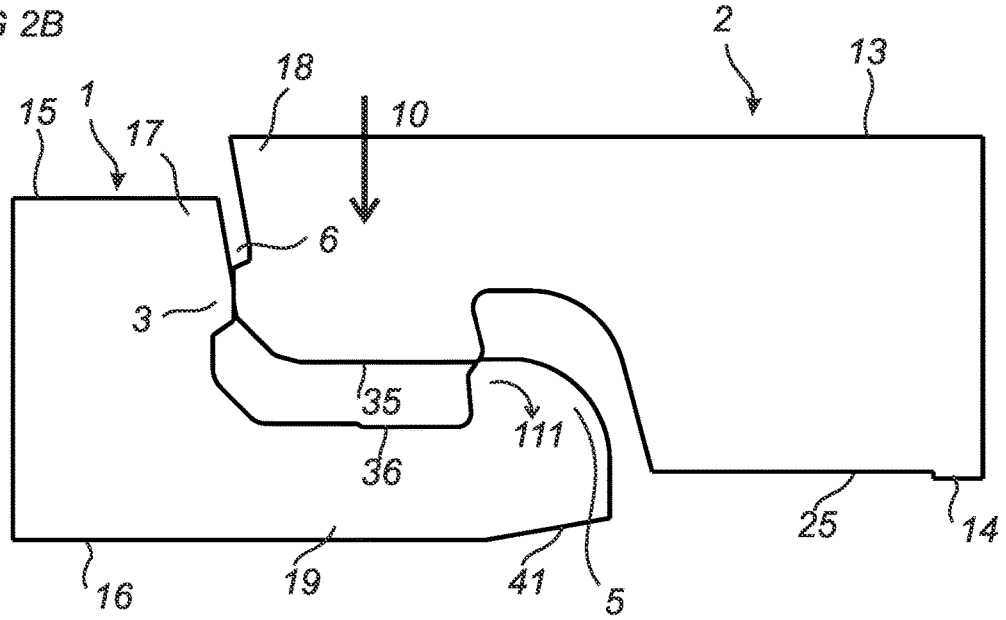
FIG. 2B shows the illustrative embodiment in FIG. 1B during assembling.

FIG. 2B shows the embodiment shown in FIG. 1A during an embodiment of the assembling. The embodiments shown in FIGS. 1C and 7 may be assembled with the same method or a similar method. The second edge 18 of the second panel 2 is being displaced in an assembly direction 10 relative the first edge 17 of the first panel 1 to obtain a locked position of the first edge and the second edge. The assembly direction 10 may be perpendicular to the first panel surface 15. FIGS. 3A-3B show the embodiment before assembling.

The locking element 5 may comprise a first guiding surface 20 at an outer surface and the locking groove 4 may comprise a second guiding surface 22 at an opening of the locking groove 4. The first guiding surface 20 is configured to cooperate with the second guiding surface 22 during assembling to guide the locking element 5 into the locking groove 4.

FIG. 5 shows that the size of the first guiding surface 20 may be greater than the size of the second guiding surface 22 which may have the effect that the guiding is improved.

The first guiding surface 20 may comprise an essentially planar surface. A planar surface can provide a greater guiding length.

The second guiding surface 22 may have a rounded shape. The rounded shape can provide a smaller contact surface between the first guiding surface 20 and the second guiding surface 22 during the assembling which may decrease the friction.

As shown for example in FIG. 5, a ratio between a length 21 of the planar surface and a radius R1 of the rounded shape of the second guiding surface 22 may be in the range of about 2 to about 5, or about 3 to about 4. The ratio mentioned above can be large enough to allow for an effective guiding over a relative great guiding length but not too large which may result in a sharp edge at the second guiding surface 22 which may break during assembling or transportation.

A transition surface between the first locking surface 31 and the strip surface 36 may have a rounded shape. The transition surface may comprise a transition radius R2. The transition radius R2 may be greater than the radius R1 of the rounded shape of the second guiding surface which may have the effect that the locking strength is increased and cracks may be avoided at the transition surface during assembling and when a load in the first direction, e.g., from a force pulling apart the panels, is applied.

A relatively smaller radius R1 of the of the rounded shape of the second guiding surface also has the effect that the cooperation part 104 is positioned closer to the strip surface 36 of the locking strip 19 which may have the effect that when a load is applied in the first direction, e.g., from a force pulling apart the panels, the load is absorbed at a part with a shorter moment arm. A shorter moment arm may have the advantage that the locking strength is increased.

The locking element 5 may be turned away in a direction 111 from the first edge 17 during the vertical displacement, and may spring back when the first edge and the second edge has reached the locked position.

As shown for example in FIG. 2B, a side of the locking strip 19 at the second panel surface 16 may comprise a space 41, such as a recess or bevel, under the locking element 5 which may facilitate turning of the locking 5 during the assembling.

The second edge 18 may be provided with a calibrating groove 25 adjacent said locking groove 4. The calibrating groove 25 may compensate for floorboards having different thickness, especially any difference in thickness at the edges of the floorboards. The calibrating groove allows that the second edge may be pushed towards a sub-floor on which the floorboards are arranged. The calibrating groove 25 shown in FIG. 2B is of a rectangular shape, however the calibrating groove may have other shapes such as a bevel.

The assembling shown in FIG. 2A-2B may comprise a displacement which is parallel to the first direction.

The panels 1, 2 may comprise a polymer material or a wood based material.

As shown for example in FIG. 3A, a distance 116 between the first panel surface 15 and the second panel surface 16 may be in the range of about 3 mm to about 15 mm, or in the range of about 5 mm to about 8 mm.

As shown for example in FIG. 3B, a distance 117 between the third panel surface 13 and the fourth panel surface 14 may be in the range of about 3 mm to about 15 mm, or in the range of about 5 mm to about 8 mm.

The locking strip 19 may protrude beyond a first joint surface 37, at the first edge 17, which is adjacent the first panel surface 15.

The second edge 18 may comprise a second joint surface 38 which is adjacent the third panel surface 13.

The first joint surface 37 may be configured to cooperate with the second joint surface 38 for a locking in a direction which is opposite to the first direction 12.

An edge surface 35 at the second edge may be configured to cooperate with the strip surface 36 for a locking in a direction which is opposite to the first direction 11. The edge surface may be positioned on the same side of the second edge 18 as the fourth panel surface 14.

The first locking surface 31 and/or the second locking surface 32 may be essentially plane surfaces.

The first panel surface 15 and the third panel surface 13 may comprises a decorative surface.

The first and the second panel may be building panels, such as floor panels, wall panels or ceiling panels.

The first and the second panel may be of a rectangular shape.

The first and the second panel may be building panels, such as floor panels, wall panels or ceiling panels.

The first edge and the second edge may be short edges of the first and the second panel.

The assembling may also comprise an angling motion along a long side of the first and or the second panel.

The embodiments described above may be resilient panels. The resilient panels may comprise a core comprising thermoplastic material. The thermoplastic material may be foamed.

The thermoplastic material may comprise polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof. The core may be formed of several layers.

The embodiments described above may comprise a decorative layer, such as a decorative foil comprising a thermoplastic material. The thermoplastic material of the decorative layer may be or comprise polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof. The decorative foil is preferably printed, for example by direct printing, rotogravure, or digital printing.

The embodiments described above may comprise a wear layer such as a film or foil. The wear layer may comprise thermoplastic material. The thermoplastic material may be polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof.

The embodiments described above may comprise a wood base core, such as HDF, MDF or plywood.

Further embodiments of the disclosure are described below.

1. A set of panels comprising a first panel (1) and a second panel (2), wherein the first panel (1) comprising a first edge (17), a first panel surface (15) and a second opposite panel surface (16) and the second panel (2) comprises a second edge (18), a third panel surface (13) and an opposite fourth panel surface (14), wherein the first edge (17) comprises a locking strip (19) with a locking element (5) configured to cooperate with a locking groove (4) at the second edge (18) of the second panel (2) for locking the first edge (17) to the second edge (18) in a first direction (12) which is parallel to the first panel surface (15), wherein the first edge (17) is configured to be assembled to the second edge by a displacement of the second edge (18) relative the first edge (17) in an assembly direction (10), which is perpendicular to the first panel surface (15), to obtain a locked position of the first edge (17) and the second edge (18) wherein the locking element (5) comprises a first locking surface (31) at a first angle (101) from a plane parallel to the first panel surface (15) and the locking groove comprises a second locking surface (32) at a second angle (102) from a plane parallel to the third panel surface (13), wherein the first angle (101) is different from the second angle (102) such that the first locking surface (31) converges towards the second locking surface (32) at a cooperation part (104) in the locked position, and the first locking surface (31) cooperates with the second locking surface (32) at the cooperation part (104) for the locking in the first direction (12).

2. The set of panels as described in embodiment 1, wherein the cooperation part (104) is closer to a strip surface (36) of the locking strip (19) than to an outer surface (7) of the locking element (5).

3. The set of panels as described in embodiment 1 or 2, wherein there is a space 115 between the first locking surface (31) and the second locking surface (32) in the locked position, wherein the space is located between the cooperation part (104) and an outer surface (7) of the locking element (5).

4. The set of panels as described in any one of the embodiments 1-3, wherein the difference (103) between the first angle (101) and the second angle (102) is in the range of about 2° to about 15°, or in the range of about 5° to about 10°, or in the range of about 5° to about 7°, or about 7.

5. The set of panels as described in any one of the embodiments 1-4, wherein the cooperation part (104) is positioned at a first distance (113) from a strip surface (36) of the locking strip (19), wherein an outer surface (7) of the locking element (5) is positioned at a second distance (114) from a strip surface (36) of the locking strip (19), and wherein a ratio between the first distance (113) and the second distance (114) is in the range of about 0.03 to about 0.3, or in the range of about 0.1 to about 0.2, 03, or about 0.15.

6. The set of panels as described in any one of the embodiments 1-5, wherein one of the first edge (17) or the second edge (18) comprises a tongue (3) which is configured to cooperate with a tongue groove (6) at the other one of the first edge (17) or the second edge (18) for a locking in a second direction (11) which is perpendicular to the first direction (12).

7. The set of panels as described in embodiments 6, wherein the tongue (3) is a flexible tongue which is located in an insertion groove at the one of the first edge (17) or the second edge (18).

8. The set of panels as described in embodiment 6 or 7, wherein the first angle (101) is in the range of about 90° to about ° 145, or in the range of about 100° to about 135°, or in the range of about 110° to about 125°, or about 120° and wherein the second angle (102) is in the range of about 80° to about 135°, or in the range of about 100° to about 115°, or about 110°.

9. The set of panels as described in any one of the embodiments 1-8, wherein the first locking surface (31) and the second locking surface (32) are configured for a locking in a second direction (11) which is perpendicular to the first direction (12).

10. The set of panels as described in embodiments 9, wherein the first angle (101) is in the range of about 70° to about 90°, or in the range of about 80° to about 89°, or in the range of about 85° to about 89°, and wherein the second angle (102) is in the range of about 75° to about 85°, or in the range of about 80° to about 85°.

11. The set of panels as described in any one of the embodiments 1-10, wherein panels comprise a polymer material or a wood based material.

12. The set of panels as described in any one of the embodiments 1-11, wherein a distance between the first panel surface (15) and the second panel surface (16) is in the range of about 3 mm to about 15 mm, or in the range of about 5 mm to about 8 mm.

13. The set of panels as described in any one of the embodiments 1-12, wherein a distance between the third panel surface (13) and the fourth panel surface (14) is in the range of about 3 mm to about 15 mm, or in the range of about 5 mm to about 8 mm.

14. The set of panels as described in any one of the embodiments 1-13, wherein the first panel surface (15) and the third panel surface (13) comprise a decorative surface.

15. The set of panels as described in any one of the embodiments 1-14, wherein the first and the second panel are building panels, such as floor panels, wall panels or ceiling panels.

16. The set of panels as claimed in any one of the claims 1-15, wherein the locking element (5) comprise a first guiding surface (20) at an outer surface and the locking groove (4) comprises a second guiding surface (22) at an opening of the locking groove (4), wherein the first guiding surface (20) is configured to cooperate with the second guiding surface (22) during assembling to guide the locking element (5) into the locking groove (4).

17. The set of panels as claimed in claim 16, wherein the size of the first guiding surface (20) is greater than the size of the second guiding surface (22).

18. The set of panels as claimed in claim 16 or 17, wherein the first guiding surface (20) comprises an essentially planar surface.

19. The set of panels as claimed in any one of the claims 16-18, wherein the second guiding surface (22) has a rounded shape.

20. The set of panels as claimed in claim 16 or 17, wherein the first guiding surface (20) comprises an essentially planar surface and the second guiding surface (22) has a rounded shape, wherein a ratio between a length (21) of the planar surface and a radius (R1) of the rounded shape of the second guiding surface is in the range of about 1 to about 5, or about 2 to about 4, or about 3.

The invention claimed is:

1. A set of panels comprising:

a first panel and a second panel, wherein the first panel comprises a first edge, a first panel surface and a second opposite panel surface, and wherein the second panel comprises a second edge, a third panel surface and an opposite fourth panel surface, wherein the first edge comprises a locking strip with a locking element configured to cooperate with a locking groove at the second edge of the second panel for locking the first edge to the second edge in a first direction which is parallel to the first panel surface, wherein the first edge is configured to be assembled to the second edge by a displacement of the second edge relative the first edge in an assembly direction, which is perpendicular to the first panel surface, to obtain a locked position of the first edge and the second edge, wherein the locking element comprises a first locking surface at a first angle from a first plane parallel to the first panel surface and the locking groove comprises a second locking surface at a second angle from a second plane parallel to the third panel surface, wherein the first angle is different from the second angle such that the first locking surface converges towards the second locking surface at a cooperation part in the locked position, and the first locking surface cooperates with the second locking surface at the cooperation part for the locking in the first direction, wherein the cooperation part is positioned at a first distance from a strip surface of the locking strip, wherein an outer surface of the locking element is positioned at a second distance from the strip surface of the locking strip, and wherein a ratio between the first distance and the second distance is in the range of about 0.03 to about 0.3.

2. The set of panels as claimed in claim 1, wherein the cooperation part is closer to a strip surface of the locking strip than to an outer surface of the locking element.

3. The set of panels as claimed in claim 1, comprising a space between the first locking surface and the second locking surface in the locked position, wherein the space is located between the cooperation part and an outer surface of the locking element.

4. The set of panels as claimed in claim 1, wherein a difference between the first angle and the second angle is in the range of about 2° to about 15°.

5. The set of panels as claimed in claim 1, wherein one of the first edge or the second edge comprises a tongue which is configured to cooperate with a tongue groove at the other one of the first edge or the second edge for a locking in a second direction which is perpendicular to the first direction.

6. The set of panels as claimed in claim 5, wherein the tongue is a flexible tongue which is located in an insertion groove at the one of the first edge or the second edge.

7. The set of panels as claimed in claim 5, wherein the first angle is in the range of about 90° to about 145°, and wherein the second angle is in the range of about 80° to about 135°.

8. The set of panels as claimed in claim 1, wherein the first locking surface and the second locking surface are configured for a locking in a second direction which is perpendicular to the first direction.

9. The set of panels as claimed in claim 8, wherein the first angle is in the range of about 70° to about 90°, and wherein the second angle is in the range of about 75° to about 85°.

10. The set of panels as claimed in claim 1, wherein the panels comprise a polymer material or a wood based material.

11. The set of panels as claimed in claim 1, wherein a distance between the first panel surface and the second panel surface is in the range of about 3 mm to about 15 mm.

12. The set of panels as claimed in claim 1, wherein a distance between the third panel surface and the fourth panel surface is in the range of about 3 mm to about 15 mm.

13. The set of panels as claimed in claim 1, wherein the first panel surface and the third panel surface comprise a decorative surface.

14. The set of panels as claimed in claim 1, wherein the first and second panels are building panels.

15. The set of panels as claimed in claim 1, wherein the locking element comprises a first guiding surface at an outer surface and the locking groove comprises a second guiding surface at an opening of the locking groove, wherein the first guiding surface is configured to cooperate with the second guiding surface during assembling to guide the locking element into the locking groove.

16. The set of panels as claimed in claim 15, wherein a size of the first guiding surface is greater than a size of the second guiding surface.

17. The set of panels as claimed in claim 15, wherein the first guiding surface comprises an essentially planar surface.

18. The set of panels as claimed in claim 15, wherein the first guiding surface comprises an essentially planar surface and the second guiding surface has a rounded shape, wherein a ratio between a length of the planar surface and a radius of the rounded shape of the second guiding surface is in the range of about 1 to about 5.

19. The set of panels as claimed in claim 1, wherein the second guiding surface has a rounded shape.

20. The set of panels as claimed in claim 1, wherein, in the locked position, the first locking surface of the locking element includes a first portion that is free of contact with the second locking surface of the locking groove, and a second portion that contacts the second locking surface at the cooperation part, the first and second portions being coplanar.

* * * * *